US011695192B2

(12) United States Patent
Skowyra et al.

(10) Patent No.: US 11,695,192 B2
(45) Date of Patent: Jul. 4, 2023

(54) IRIS COUPLED COAXIAL TRANSMISSION LINE TO WAVEGUIDE ADAPTER

(71) Applicant: Millimeter Wave Systems, LLC, Amherst, MA (US)

(72) Inventors: Martin Skowyra, Palmer, MA (US); William R. Shedd, Palmer, MA (US); Christopher Tze-Chao Koh, Amherst, MA (US)

(73) Assignee: Millimeter Wave Systems, LLC, Amherst, MA (US)

( * ) Notice: Subject to any disclaimer, the term of this patent is extended or adjusted under 35 U.S.C. 154(b) by 30 days.

(21) Appl. No.: 17/386,196

(22) Filed: Jul. 27, 2021

(65) Prior Publication Data

US 2022/0037756 A1 Feb. 3, 2022

Related U.S. Application Data

(60) Provisional application No. 63/058,219, filed on Jul. 29, 2020.

(51) Int. Cl.
*H01P 5/103* (2006.01)

(52) U.S. Cl.
CPC ..... *H01P 5/103* (2013.01)

(58) Field of Classification Search
CPC ..... H01P 5/103; H01P 5/107
USPC ..... 333/26
See application file for complete search history.

(56) References Cited

U.S. PATENT DOCUMENTS

| | | | | |
|---|---|---|---|---|
| 2,981,904 | A * | 4/1961 | Ajioka et al. | H01P 5/103 333/34 |
| 3,023,382 | A * | 2/1962 | Borghetti | H01P 5/103 333/252 |
| 3,737,812 | A | 6/1973 | Gaudio et al. | |
| 3,942,138 | A * | 3/1976 | Schaedla | H01P 5/103 333/33 |
| 2008/0003872 | A1* | 1/2008 | Chen et al. | H01P 5/103 439/578 |
| 2013/0271235 | A1* | 10/2013 | Kai | H01P 5/08 333/34 |

OTHER PUBLICATIONS

Pozar, D.,"Microwave Engineering", 4th Ed. (2012 John Wiley & Sons), pp. 203-206.
Herres, D., "The Difference Between Metal Conductors and Waveguides" Jan. 28, 2019 at http://www.testandmeasurementtips.com/.
Fiolia et al., "An Iris Polarizer In Coaxial Waveguide," Digest on Antennas and Propagation Society International Symposium, 1989, pp. 961-964 vol. 2.
"Microwave Engineering"—"Waveguide Discontinuities"—"Waveguide Irises" https://electronics-club.com/waveguide-discontinuities/ Dec. 13, 2020.
Wheeler, G., "Broadband Waveguide-to-Coax Transitions", IRE International Convention Record, vol. 5, pp. 182-185 (1957).

* cited by examiner

*Primary Examiner* — Benny T Lee
(74) *Attorney, Agent, or Firm* — David J. Thibodeau, Jr.; VLP Law Group, LLP

(57) ABSTRACT

An adapter for coupling a coaxial transmission line to a waveguide, wherein the center conductor of the coaxial line passes via a back short of the waveguide through an iris and that terminates to the inside wall of the waveguide.

9 Claims, 7 Drawing Sheets

IRIS COUPLED COAXIAL TRANSMISSION LINE TO WAVEGUIDE ADAPTER

CROSS REFERENCE TO RELATED APPLICATIONS

This application claims priority to U.S. Provisional Patent Application Ser. No. 63/058,219 filed Jul. 29, 2020 entitled "Coaxial Iris Coupled Waveguide Adapter", the entire contents of which are hereby incorporated by reference.

BACKGROUND

Technical Field

This application relates to interconnecting a waveguide to a coaxial transmission line.

Introduction

Waveguide to coaxial transitions are commonly used to efficiently convert a TE10 waveguide mode to a coaxial waveguide TEM mode. So called "in line" transitions are a class of coaxial-to-waveguide transition wherein the coaxial transmission line carrying a TEM mode is physically oriented in the same propagating direction as the rectangular waveguide transmission line carrying a TE10 mode and have been in existence since at least the 1950s. See for example Wheeler, G., "Broadband waveguide-to-coax transitions", IRE International Convention Record, vol. 5, pp. 182-185 (1957) doi: 10.1109/IRECON.1957.1150581. As shown in the cross-section of FIG. 1 for, such a transition, the center conductor 103 of a coaxial (i.e., "coax") transmission line 110 is shorted resulting in current flow that gives rise to a magnetic field that couples to the TE10 mode of the waveguide 102, henceforth referred to as a "magnetic loop" 104. The waveguide 102 is closed at one end by a short circuit wall 105 or back short and the coax 110 is connected at the wall 105. The center conductor 103 of the coax 110 enters the waveguide 102 at the wall 105 and is bent forming a shorting elbow to one of the broad walls 106 of the waveguide 102 forming a magnetic loop 104 that couples to the TE10 propagating mode of the waveguide 102. Outer conductor 108 and dielectric section 101 of the coax 110 are also shown.

Other prior art exists for magnetically coupled transitions, including Gaudio et al. U.S. Pat. No. 3,737,812. This approach employed stepped ridges 107 in the center of the waveguide 102 to form the magnetic loop 104 as shown in cross section in FIG. 2. The steps comprise a wideband impedance transformer capable of producing good RF match over entire waveguide bands in addition to completing the current path to the wall.

SUMMARY OF PREFERRED EMBODIMENTS

One limitation of these prior art transitions is that these transitions usually require multiple complex 3-dimensional parts because the enclosed rectangular guide and coaxial transmission line cannot be machined or extruded as one part. Another limitation of the prior art is the small physical size of the coax required to maintain an effective waveguide back short.

As described herein, preferred embodiments include a coaxial transmission line coupled to a waveguide, wherein the center conductor of the coaxial line passes through the back short of the waveguide through an iris and that terminates at one of the inside walls of the waveguide. In some embodiments, the transmission line and waveguide may be formed in a planar substrate.

In some embodiments, the iris may be fabricated separately from the waveguide as part of a shim.

An advantage over the prior art is that the iris can be easily fabricated into flat sheets of conductive material using processes such as machining, chemical milling or laser cutting, and attached to a waveguide section. This eliminates overhanging material allowing the waveguide section, and indeed the entire transition, to be fabricated using simple manufacturing processes such as CNC machining or casting.

Our approach is not dependent on the shim itself. The shim is but one possible convenient implementation of the iris.

BRIEF DESCRIPTION OF THE DRAWINGS

Additional novel features and advantages of the approaches discussed herein are evident from the text that follows and the accompanying drawings, where like features are denoted by the same reference numbers throughout the detail descriptions of the drawings, and in which.

DETAILED DESCRIPTION OF ILLUSTRATIVE EMBODIMENT(S)

Figure 3:
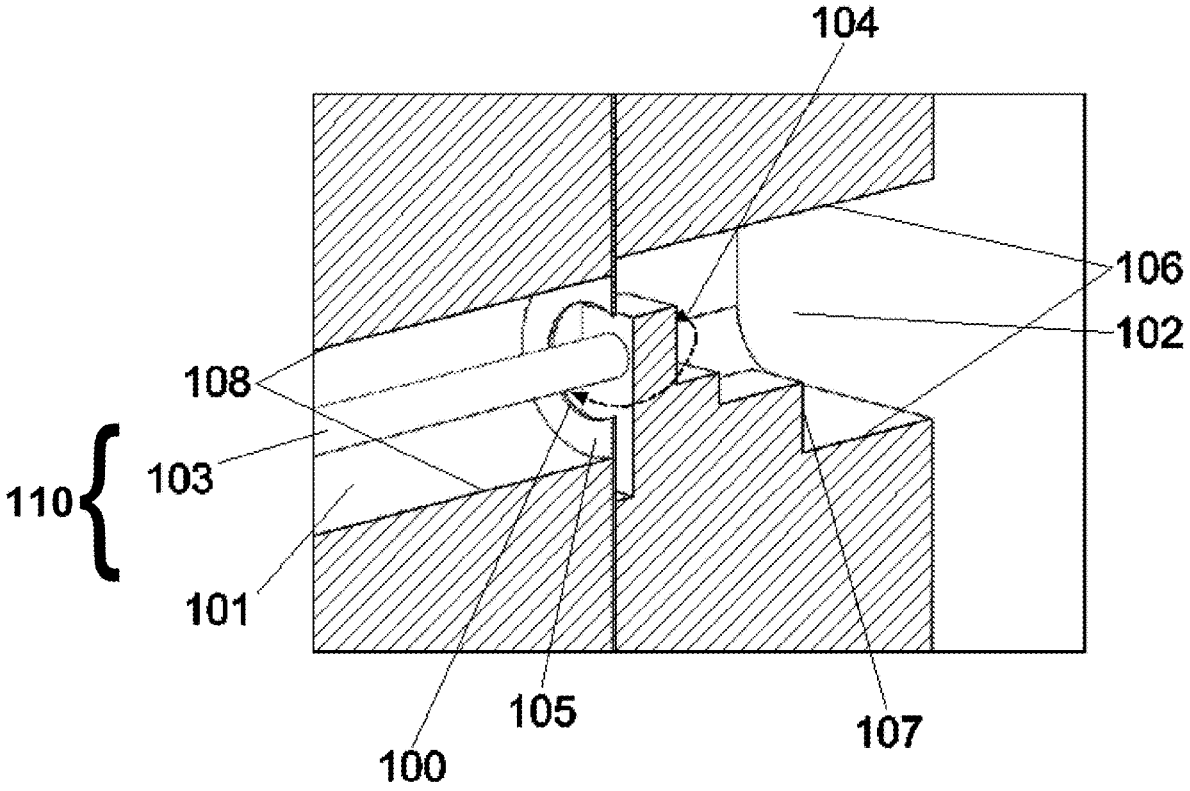
FIG. 3 is a cross-sectional view of a novel coaxial transmission line to waveguide adapter where a center conductor of a coaxial line section passes through a back short of the waveguide and through an iris.
Figure 6:
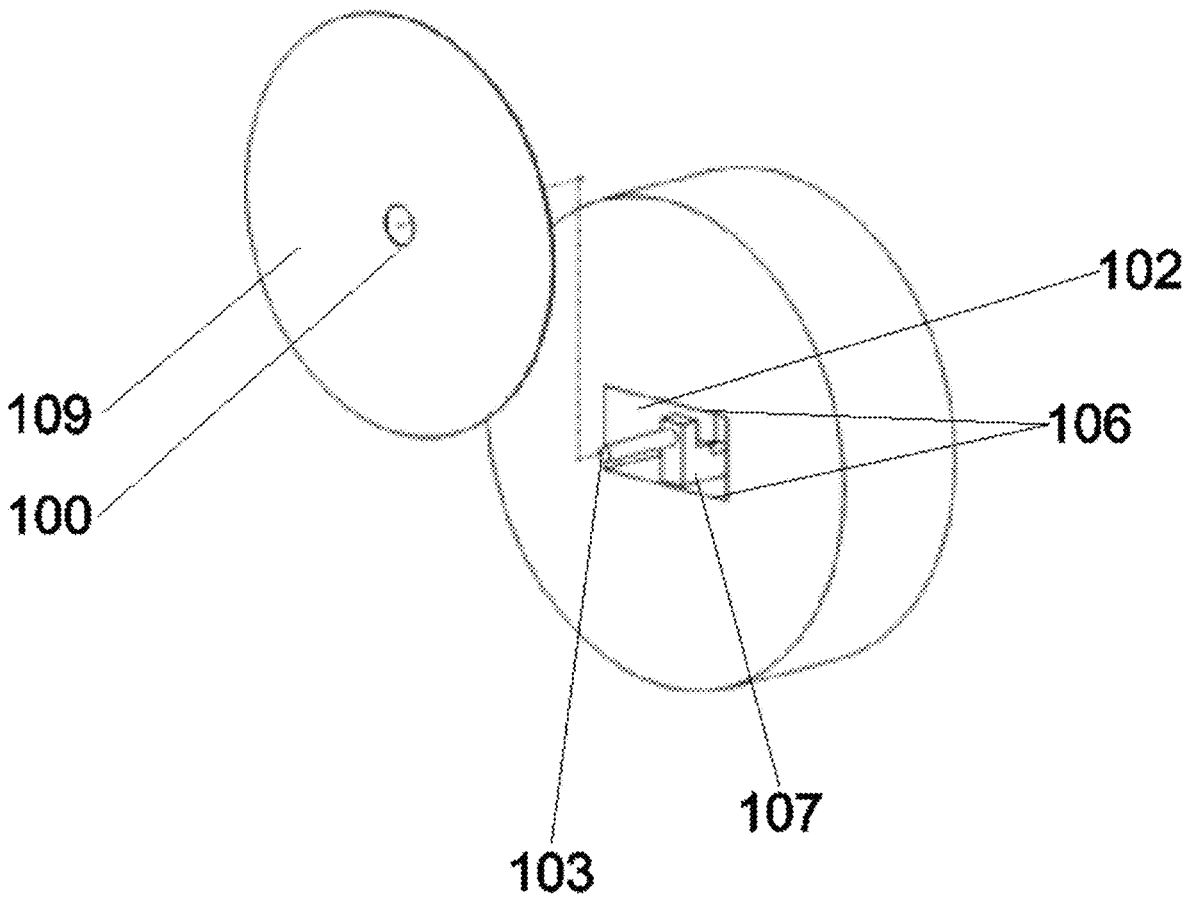
FIG. 6 is another arrangement of the novel adapter.

Referring to FIG. 3 and FIG. 6, an illustrative embodiment may be comprised of a coaxial transmission line 110 with center conductor 103, dielectric 101 (FIG. 3), and outer conductor 108 (FIG. 3), a thin conducting wall 105 (FIG. 3) with a hole forming an iris 100, possibly fabricated as a metal shim 109 (FIG. 6) with a circular hole, wherein the center conductor passes through the iris 100. The thin conducting wall 105 is placed across the waveguide 102 to form a shorting plane or back short to the waveguide TE10 mode. (In other words, the waveguide is shorted in some way). The center conductor 103 terminates into a ridge 107 in the waveguide 102 that forms a magnetic loop 104 (FIG. 3).

The iris dimensions may be adjusted to vary the reactance of the iris. This in turn is used to match the impedance of the coaxial section to the waveguide section. A selection of thin conducting walls with varying iris dimensions can therefore be prepared prior to the manufacture and/or test of a coaxial transmission line to waveguide transition. Examples of iris dimensions to vary include their thickness, and if circular, their radius. Using this prepared selection, irises of various dimensions can be swapped in and out during testing in order to tune the match of the transition.

Figure 7:
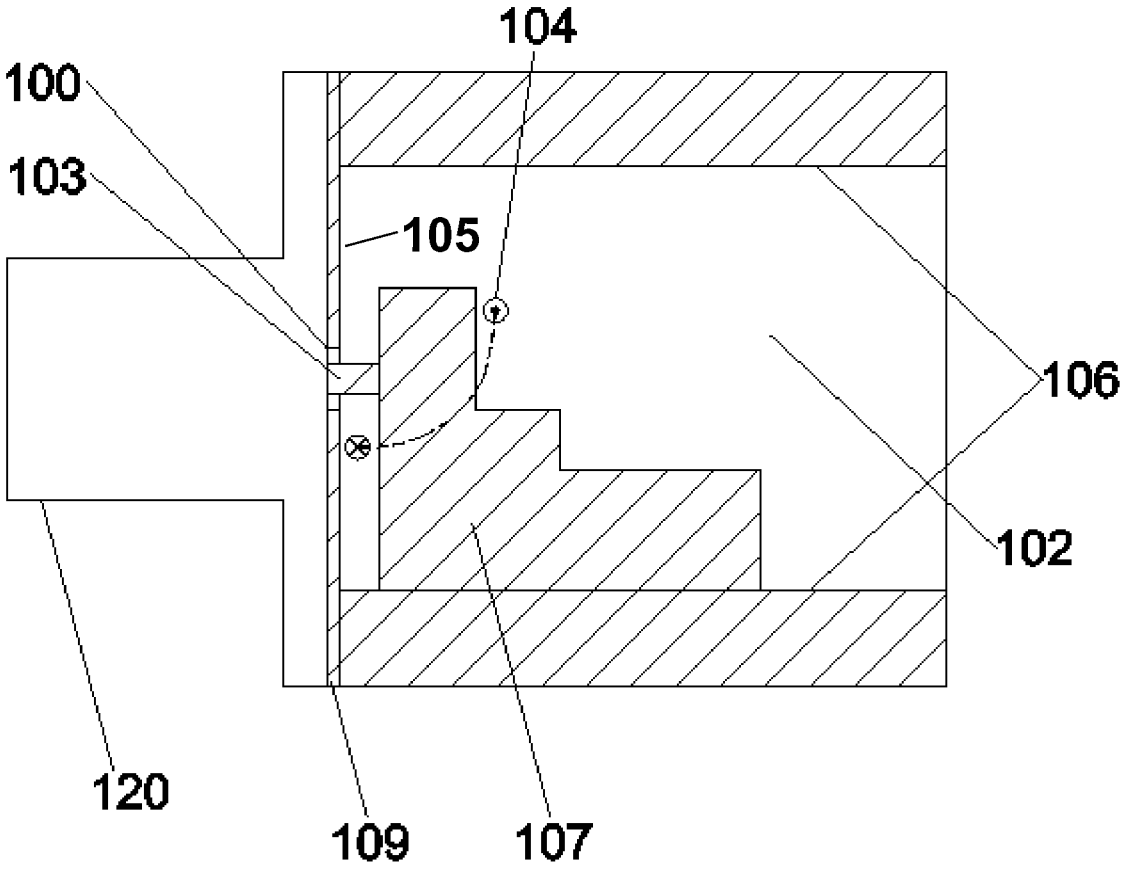
FIG. 7 is an embodiment where the coaxial section is provided by a coaxial connector.

In one embodiment, the coaxial transmission line, which may be any TEM mode transmission line, is provided by another structure, such as a coaxial connector 120. FIG. 7 illustrates this case, where the coaxial transmission line section shown in FIG. 3 is provided by a launch end of a coaxial connector 120. In the example illustrated in FIG. 7, the iris 100 is formed in a thin metal shim 109 and a center conductor 103 terminates into the launch end of the coaxial connector 120, passes through the iris 100, and terminates into the stepped ridge 107 inside the waveguide 102.

The iris 100 aperture closes tightly around the center conductor 103 of the coaxial transmission line such that the coaxial impedance formed by the center conductor 103 and iris 100 is less than the impedance of the coaxial transmission line. This allows back short currents to flow largely unobstructed in the end wall 105 of the waveguide 102 resulting in a more effective magnetic loop return path and waveguide back short.

Figure 4:
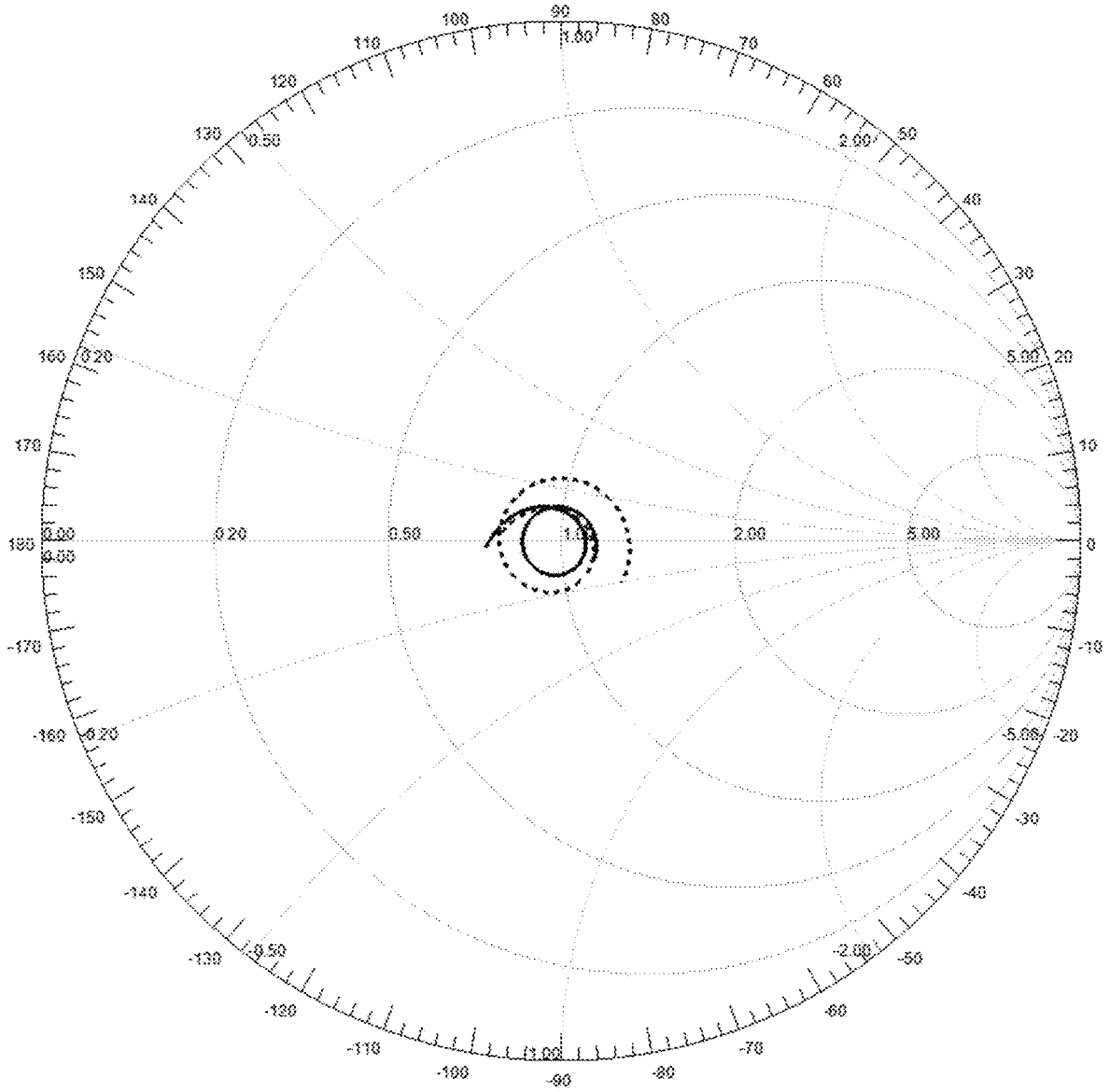
FIG. 4 is a Smith chart resulting from a computer model of the novel adapter.
Figure 5:
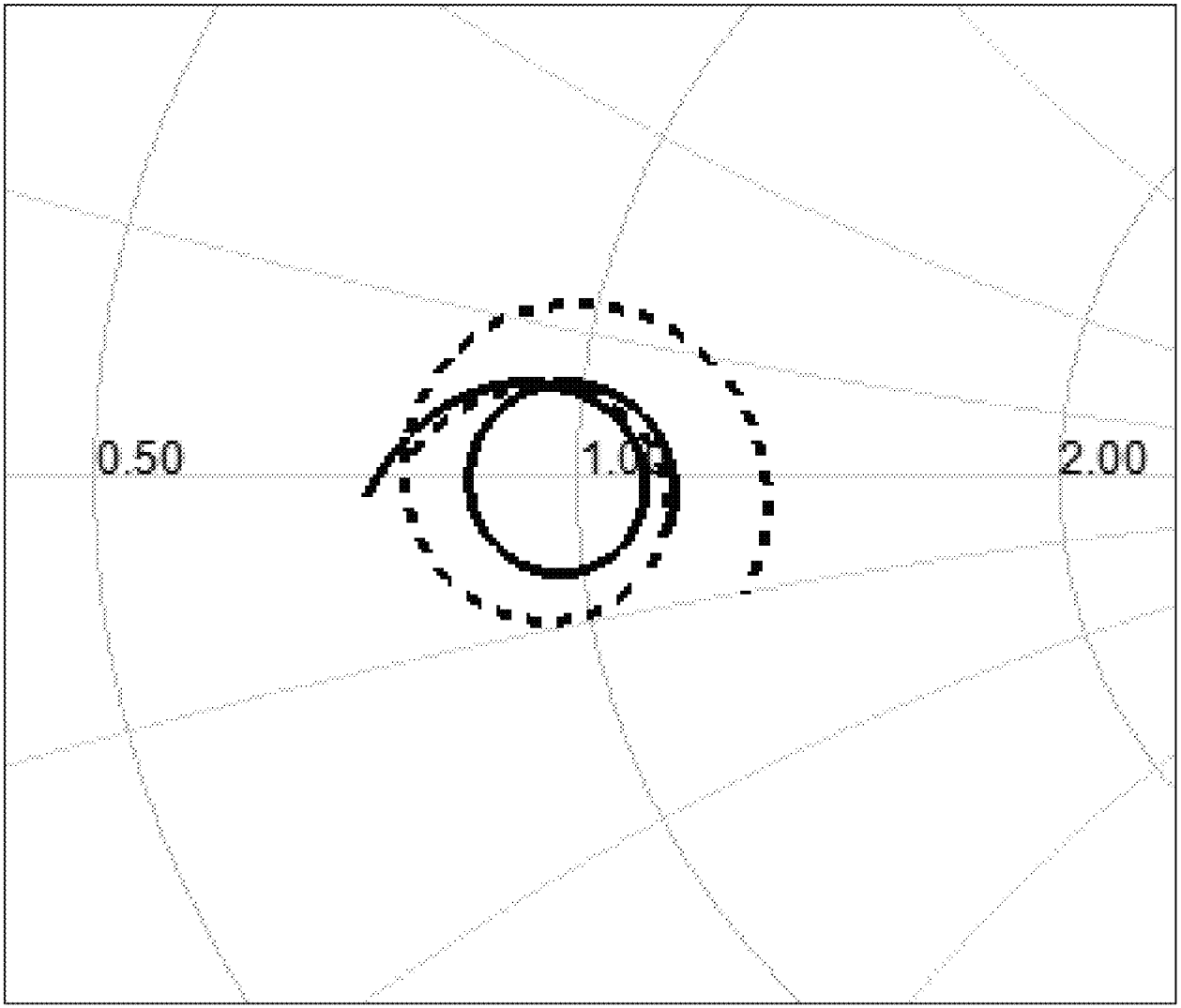
FIG. 5 a zoomed in view of the same Smith chart as FIG. 4, centered on 50Ω impedance.

Results of a computer model, with and without the iris, shows the effect of the iris on return loss. Referring to FIG. 4, the solid line on the Smith chart shows the improved match with the iris, whereas the dashed line shows the performance without the iris. FIG. 5 shows a more detailed view of the Smith chart shown in FIG. 4. (The scale of the horizontal axis in the Smith charts represents normalized impedance). The example computer model used a 50 ohm impedance coax section, WR-15 rectangular waveguide and a wall thickness of 0.001 inches. The frequency limits on the plot are 50 GHz to 75 GHz. Other waveguide bands and wall thicknesses are envisioned as are similarly functioning geometries. For example, a circular waveguide TE11 mode adapter would make an efficient transition in this same manner. Furthermore, the iris could be square or irregular in shape.

An advantage over prior art is that the iris 100 can be easily fabricated into flat sheets of conductive material, or shims 109, using processes such as machining, chemical milling or laser cutting, and attached to the waveguide section to form the back short as shown in FIG. 6. This eliminates overhanging material allowing the waveguide section to be fabricated using simple manufacturing processes such as CNC machining or casting. The entire transition can therefore be manufactured with only one complex part that can be made using simple manufacturing processes.

The preferred embodiments are not dependent on the thin conducting wall, or shim 109 itself. The shim is therefore but one convenient implementation of the iris. In a more general conceptualization, an arbitrary TEM transmission line may be utilized, coupled to a waveguide wherein the center conductor of the coaxial line passes through the back short of the waveguide through an iris and where the center conductor terminates at one of the inside walls of the waveguide. The center conductor need not be rotationally symmetric around the TEM transmission line's axis of propagation as shown in FIGS. 3 and 6.

Other types of transmission lines, such as a microstrip or coplanar waveguide may have TEM and TM modes. Therefore, an iris, as described above, may also be used to launch these other types of transmission lines into rectangular or circular waveguides.

Figure 1:
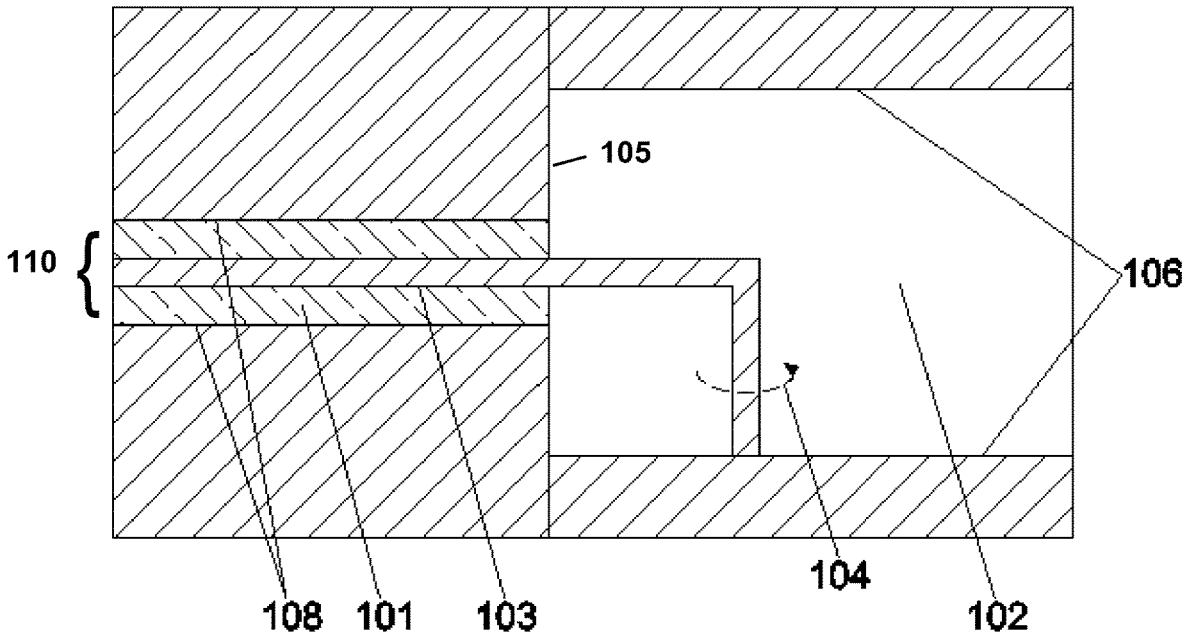
Figure 1 PRIOR ART
FIG. 1 is a cross-sectional view of a prior art coaxial line to waveguide transition.
Figure 2:
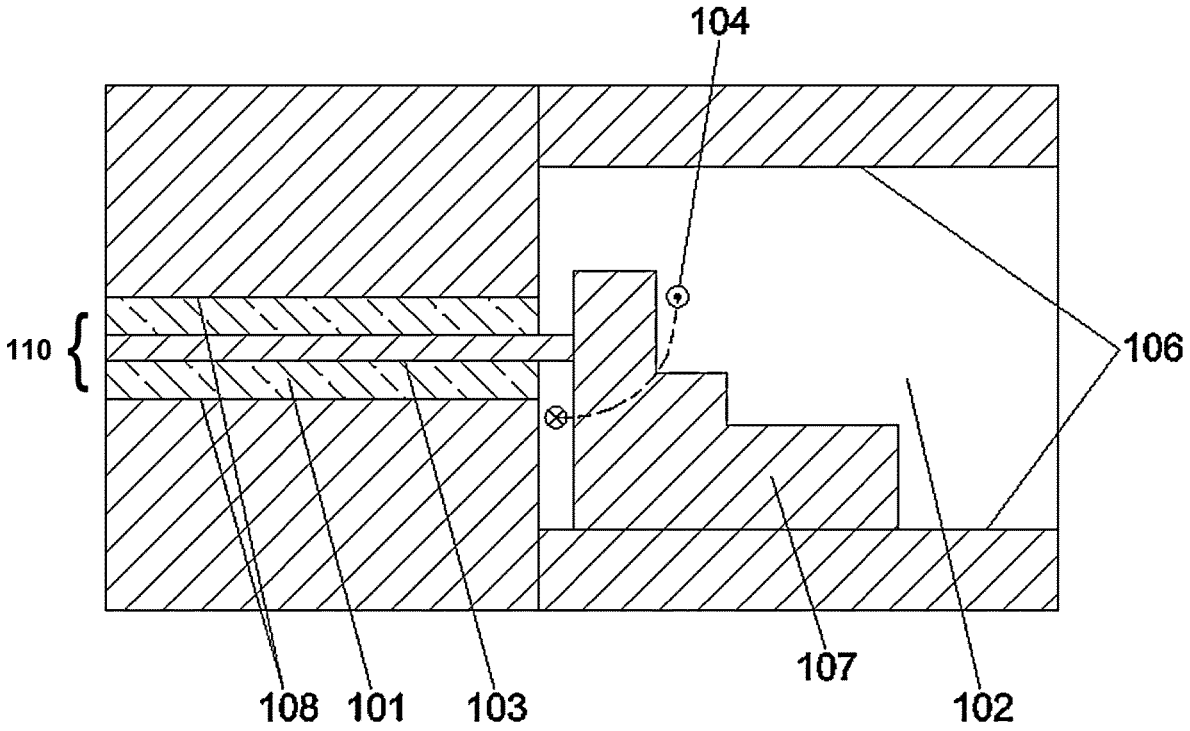
Figure 2 PRIOR ART
FIG. 2 is a cross-sectional view of another prior art coaxial line to waveguide transition.

Furthermore, the TEM mode need not be the sole significant propagating waveguide mode in the transmission line. The inside walls of the waveguide need not have a feature for the center conductor to make contact with. The center conductor may instead contact with a broadwall 106 of the waveguide as shown in FIG. 1. The dielectric 101 (FIG. 3) between the center and outer conductors of the arbitrary TEM transmission line could be occupied by vacuum or air with a dielectric constant approximately equal to 1.0.

The above description has particularly shown and described example embodiments. However, it will be understood by those skilled in the art that various changes in form and details may be made therein without departing from the legal scope of this patent as encompassed by the appended claims.

The invention claimed is:

1. An apparatus for coupling a coaxial transmission line to a waveguide comprising:

a coaxial section having a center conductor, a waveguide having an inside wall, a shorted end, and an iris, and wherein the center conductor of the coaxial section passes through the iris adjacent the shorted end of the waveguide, and electrically terminates to the inside wall of the waveguide.

2. The apparatus of claim 1 wherein the iris is formed as a circular, square, or irregularly shaped opening in a conductive shim.

3. The apparatus of claim 1 wherein the iris is fabricated as a separate part and affixed to the coaxial transmission line and waveguide.

4. The apparatus of claim 1 wherein the coaxial section is provided by a launch end of a coaxial connector.

5. The apparatus of claim 1 wherein the waveguide is rectangular in cross section.

6. The apparatus of claim 1 wherein the inside wall of the waveguide is a broadwall.

7. The apparatus of claim 1 wherein the iris is a circular hole formed in a metal disk.

8. The apparatus of claim 1 wherein the iris is configured to provide an impedance discontinuity between the coaxial section and the rectangular waveguide.

9. The apparatus of claim 1 additionally wherein the center conductor terminates at a ridge connected to the inside wall of the waveguide.

* * * * *